US011546715B2

(12) United States Patent
Faaborg et al.

(10) Patent No.: US 11,546,715 B2
(45) Date of Patent: Jan. 3, 2023

(54) SYSTEMS AND METHODS FOR GENERATING VIDEO-ADAPTED SURROUND-SOUND

(71) Applicant: Google LLC, Mountain View, CA (US)

(72) Inventors: Alexander James Faaborg, Mountain View, CA (US); Lucas Ochoa, Mountain View, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/302,488

(22) Filed: May 4, 2021

(65) Prior Publication Data

US 2022/0360933 A1 Nov. 10, 2022

(51) Int. Cl.

| | |
|---|---|
| ***H04S 7/00*** | (2006.01) |
| ***G10L 19/008*** | (2013.01) |
| ***G10L 19/16*** | (2013.01) |
| ***H04S 3/00*** | (2006.01) |
| ***G10L 19/26*** | (2013.01) |

(52) U.S. Cl.

CPC ..... *H04S 7/304* (2013.01); *G10L 19/008* (2013.01); *G10L 19/167* (2013.01); *G10L 19/26* (2013.01); *H04S 3/004* (2013.01); *H04S 2420/01* (2013.01); *H04S 2420/03* (2013.01)

(58) Field of Classification Search

CPC ..... H04S 7/304; H04S 3/004; H04S 2420/01; H04S 2420/03; G10L 19/008; G10L 19/167; G10L 19/26

USPC ..... 381/310

See application file for complete search history.

(56) References Cited

U.S. PATENT DOCUMENTS 9,591,418 B2 * 3/2017 Shenoy ..... H04R 29/00

FOREIGN PATENT DOCUMENTS

| | | |
|---|---|---|
| CN | 111526242 A | 8/2020 |
| WO | 2018026963 A1 | 2/2018 |

OTHER PUBLICATIONS

"Control Spatial Audio On Airpods With Iphone", Apple, iPhone User Guide, Jan. 6, 2021, 6 pages.

* cited by examiner

*Primary Examiner* — Paul Kim

(74) *Attorney, Agent, or Firm* — Brake Hughes Bellermann LLP

(57) ABSTRACT

Audiovisual presentations, such as film recordings, may have been originally created having an audio soundtrack with multiple audio tracks mixed for a surround sound system that includes a set of speakers physically surrounding a user. The present disclosure presents systems and methods to remix these soundtracks into 3D audio that when presented to the ears of a user can be perceived as a virtual surround sound system that mimics the physical system. What is more, the disclosed systems and methods can enhance the virtual surround sound system by adjusting virtual speakers of the virtual surround sound system according to video content of the audiovisual presentation. Further enhancement may be possible by adjusting the virtual speakers of the virtual surround sound system according to a sensed position of a user.

21 Claims, 11 Drawing Sheets

SYSTEMS AND METHODS FOR GENERATING VIDEO-ADAPTED SURROUND-SOUND

FIELD OF THE DISCLOSURE

The present disclosure relates to surround audio (i.e. surround sound) and more specifically to systems and methods for remixing audio for a physical surround sound system to three-dimensional audio (3D audio) corresponding to virtual speakers in a virtual environment.

BACKGROUND

Surround sound includes presenting multiple audio channels over speakers arranged in a layout to provide a user positioned in the layout with an immersive audio experience. The audio for each channel may be mixed so that some sounds are presented (i.e., played) at certain speakers.

SUMMARY

In at least one aspect, the present disclosure generally describes a method for remixing an audiovisual (AV) presentation. The method includes receiving the AV presentation that includes a video portion and a real surround sound soundtrack. The real surround sound soundtrack includes multiple audio channels configured for playback on real speakers in a real surround sound setup that is arranged according to a surround sound setup specification. The method further includes defining virtual locations of virtual speakers in a virtual surround sound setup based on the surround sound setup specification. The method further includes modifying a virtual location of one of the virtual speakers according to a location of a first speaking character in the video portion of the AV presentation. The method further includes remixing the multiple audio channels based on the virtual locations of the virtual speakers and based on the modified virtual location of one of the virtual speakers to generate 3D audio corresponding to the virtual speakers playing the multiple audio channels in a virtual surround sound setup. The method further includes updating the AV presentation to include a virtual surround sound soundtrack including the 3D audio.

In a possible implementation of the method above, remixing the multiple audio channels includes operations performed for each of the multiple audio channels. The operations include splitting the audio channel into a left channel and a right channel. The operations further include receiving a corresponding virtual location for the audio channel. The operations further include adjusting one or more of an adjustable filter, an adjustable delay, and an adjustable amplifier/attenuator in the left channel and the right channel according to the corresponding virtual location to create one or more of a relative filter difference, a relative delay difference, and a relative gain/attenuation difference between the left channel and the right channel so that the 3D audio sounds to a user as being from the corresponding virtual location. Further, the operations can include combining the respective left channels and the respective right channels to create 3D audio that sounds to a user as being from a virtual surround sound setup after 3D audio is created for each of the multiple audio channels.

In another possible implementation of the method above, the modifying the virtual location of one of the virtual speakers to a location of a first speaking character in the video portion of the AV presentation includes selecting a dialog channel from the multiple audio channels and analyzing the dialog channel to identify speech. The modifying a virtual location further includes analyzing the video portion of the AV presentation to recognize gestures corresponding to the speech, locating the first speaking character in the video portion of the AV presentation based on the gestures corresponding to the speech, and modifying the virtual location of a virtual center speaker to playback the dialog channel at the location of the first speaking character.

In another possible implementation of the method above, the method further includes playing the AV presentation including the virtual surround sound soundtrack to a user, sensing a position/orientation of the user, and adjusting the virtual location of the virtual speakers in relation to the user according to the sensed position/orientation.

In another aspect, the present disclosure generally describes a method for remixing an audiovisual (AV) presentation. The method includes receiving the AV presentation, which includes a video portion and a real surround sound soundtrack. The real surround sound soundtrack includes multiple audio channels configured for playback on real speakers in a real surround sound setup. The real surround sound setup is arranged according to a surround sound setup specification. The method further includes selecting a dialog channel from the multiple audio channels and analyzing the dialog channel to identify speck from multiple speaking characters. The method further includes creating a plurality of new dialog channels for each of the multiple speaking characters, where each new dialog channel includes the speech from one of the multiple speaking characters. The method further includes determining locations for each of the multiple speaking characters in the video portion of the AV presentation and defining virtual locations of virtual dialog speakers for playback of the plurality of new dialog channels, the virtual locations of the virtual dialog speakers each corresponding to a location of one of the multiple speaking characters in the video portion of the AV presentation. The method further includes determining virtual locations of other virtual speakers for playback of the multiple audio channels not selected as the dialog channel, where each virtual location of each other virtual speaker corresponds to a surround sound setup specification. The method further includes remixing the multiple audio channels, including the plurality of new dialog channels, based on the virtual locations to generate 3D audio and updating the AV presentation to include a virtual surround sound soundtrack that includes the 3D audio.

In another aspect, the present disclosure generally describes a system for presenting an audiovisual (AV) presentation. The system includes a screen configured to display a video portion of the AV presentation to a user and an audio device worn by the user. The audio device includes a left speaker and a right speaker that are configured to play a virtual surround sound soundtrack including 3D audio corresponding to a virtual surround sound setup that includes a virtual speaker having a virtual location that tracks a speaking character on the screen. The audio device further includes a sensor configured to sense a position of the user relative to the screen and a processor configured to update the 3D audio so that the virtual location of the virtual speaker is adjusted based on the position of the user relative to the screen.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The components in the drawings are not necessarily to scale relative to each other. Like reference numerals designate corresponding parts throughout the several views.

DETAILED DESCRIPTION

For years audiovisual (AV) presentations (e.g., films, movies, videos, animations, shows, multimedia, media, etc.) have included a real surround sound soundtrack including multiple audio tracks mixed for presentation in a viewing location (e.g., theater, auditorium, hall, room, home theater, etc.) with real speakers (i.e. physical speakers) arranged according to a surround-sound specification. A user positioned at the viewing location in the real surround sound setup (i.e., physical surround sound setup) may view the AV presentation visually on a screen while the multi-channel audio may be presented at various real (i.e., physical) speakers around the user so that the user has a more immersive experience. Lately, more users may view an AV presentation using ear-worn audio devices (e.g., earbuds, headphones, etc.). An opportunity exists for improving the mix of the audio presented on the ear-worn audio devices (i.e., ear-worn devices) to not only replicate the immersive experience of previous (i.e., traditional) surround sound systems, but to further enhance the immersive experience based on information obtain from video content and/or from a user/environment. The present disclosure describes systems and methods to generate/provide this enhanced immersive audio experience, and the systems and methods may be applied to previously recorded and mixed AV presentations (e.g., movies with 5.1 surround sound) to improve an immersive quality of the audio when the audio is played using ear-worn audio devices.

Figure 1:
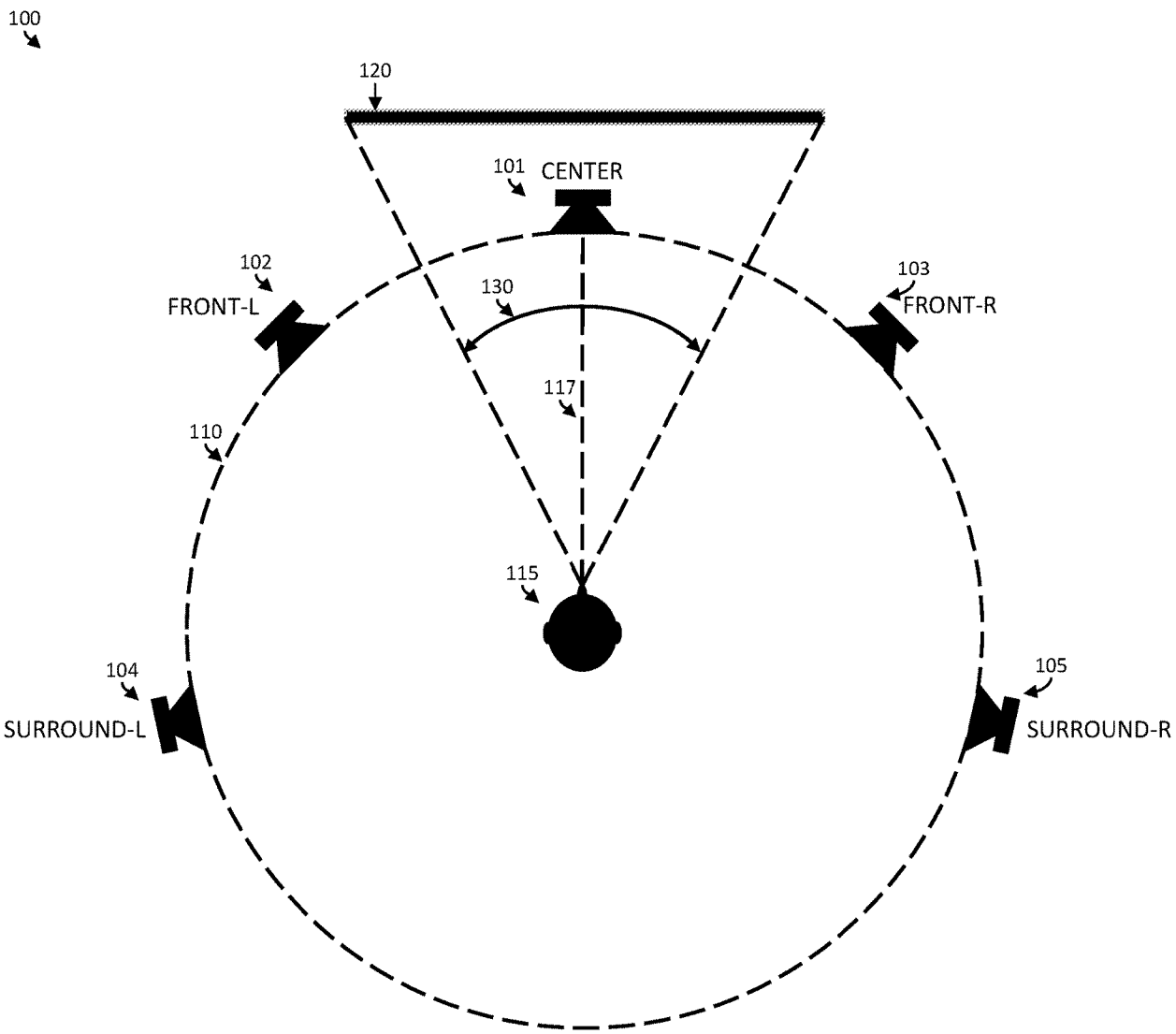
FIG. 1 is a top view of a real surround sound setup according to an implementation of the present disclosure.

FIG. 1 illustrates an example of a surround-sound layout (i.e. surround-sound setup, surround-sound system). The example surround-sound layout 100 can be for a home theater in which a user 115 views a film presented on a screen 120 while listening to corresponding sounds from an arrangement of speakers. The surround-sound layout shown includes five speakers that, according to their arrangement, define a listening area 110. The surround-sound setup further includes a screen 120 configured to present a video portion of the film. A user 115 can be positioned in a center of the listening area 110 facing the screen 120 so that the user can watch the film on the screen 120 while audio tracks corresponding to the film can be presented at the five speakers. The user's binaural hearing, the positions of the speakers, and the audio content at each speaker can provide the user with an immersive audio experience in which the sounds presented appear spatially consistent with the AV presentation.

The present disclosure is not limited to any particular stereo setup or surround-sound setup. For example, a surround sound setup may include five speakers surrounding a listener and a low-frequency effects (LFE) speaker (e.g., 5.1 surround sound) or seven speakers surrounding a listener and a LFE speaker (e.g., 7.1 surround sound). Additionally, the surround sound setup may use speakers (or reflectors) to create sounds from above a user (e.g. ATMOS surround sound). In the present disclosure, a 5.1 surround sound setup for a home theater is described because of its ubiquity. For example, many films (i.e., movies) include a 5.1 surround-sound soundtrack. The principles and technology disclosed, however, can be applied to other surround sound systems, other AV presentations, and other venues.

FIG. 1 illustrates surround sound setup according to an implementation of the present disclosure. In particular five speakers of a 5.1 surround sound setup are illustrated. As shown, the five speakers can include a center speaker (i.e., center) located in a position in front of a user 115 at the screen 120. In other words, the center speaker can be located in a direction that is zero degrees (i.e., 0°) off a user's line of sight 117. The five speakers can further include a front-left speaker 102 (i.e., front-L) and a front right speaker 103 (i.e., front-R) speaker located to the left and to the right of the screen. For example, the front-R speaker can be located in a direction that is +30° off the user's line of sight 117 and the front-L speaker can be located along a direction that is −30° off the user's line of sight 117. The five speakers can further include a surround left speaker 104 (i.e., surround-L) and a surround right speaker 105 (i.e., surround-R). For example, the surround-R speaker 105 can be located along a direction that is 110° off the user's line of sight 117 and the surround-L speaker 104 can be located along a direction that is −110° off the user's line of sight 117.

The screen 120 of the surround-sound layout 100 may be of various types and sizes. A width of the screen may correspond to an angular field of view 130 of the user that extends past the center speaker. As a result, in the surround-sound layout 100, a person speaking in at a left side of the screen or right side of the screen may appear at an angle off the user's line of sight 117. Audio signals corresponding to each speaker, however, may be transmitted along the same direction (i.e., along the user's line of sight 117) by the center speaker 101. In other words, an audio impression created by the setup may not be well aligned with a visual impression created by the setup because a speaker at a left or right side of the screen can have audio primarily transmitted by the center channel (i.e., along the user's line of sight 117).

Each speaker in the surround sound setup (i.e., surround sound system) may play a different channel of audio. In other words, an AV presentation may have audio mixed with the surround-sound setup in mind so that certain sounds play on certain speakers. Accordingly, the speakers in the surround-sound setup may have different operating characteristics (e.g., frequency response, dynamic range, etc.) to handle corresponding audio signals for each speaker. In some implementations, a speaker in the surround-sound setup may include several sub-speakers. For example, the center speaker may include one or more of a woofer sub-speaker configured for low frequency audio signals, a mid-range sub-speaker configured for mid-range frequency audio signals, and a tweeter sub-speaker configured for high frequency audio signals.

Figure 2:
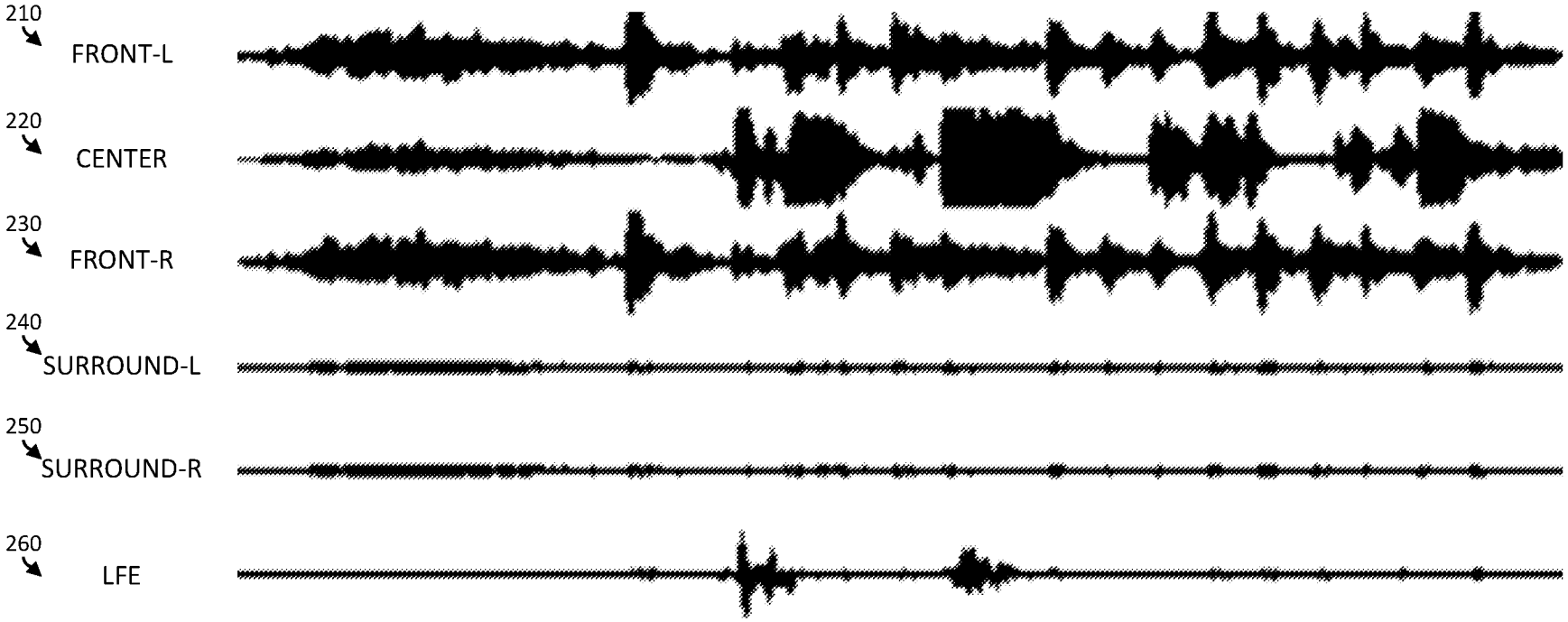
FIG. 2 are example audio channels for a possible 5.1 surround-sound system according to an implementation of the present disclosure.

FIG. 2 illustrates example audio channels (i.e., audio signals) for a possible 5.1 surround-sound system (i.e., surround-sound setup). The audio channels may be part of a soundtrack for an audio-visual presentation. The front left signal 210 and the front right signal 230 resemble each other and may include audio corresponding to sounds not presented on the screen, including (but not limited to) background sounds for the AV presentation (e.g., music). The surround left signal 240 and the surround right signal 250 have a low level of modulation that resembles the front left signal 210 and the front right signal 230. The sounds presented on these speakers may be a lower intensity and a spatialized version of the sounds presented on the Front-L and Front-R speakers. The LFE signal 260 (i.e., the subwoofer signal) includes bursts of sound and may represent low non-directed noises (e.g., booms, crashes, etc.). The center signal 220 can have audio corresponding to action presented on the screen. Accordingly, the center signal 220 can have a high level of modulation because the action often includes the speech of the characters presented on the screen. As a result, the center channel may be referred to as the dialogue channel because it includes speech from one or more characters on the screen.

The center signal 220 can be mixed, when the AV presentation is recorded, as a single channel in a surround-sound mix of audio channels (e.g., see FIG. 2). Accordingly, when played on the center speaker 101 of a 5.1 surround-sound setup (see FIG. 1), the center signal audio is directed from the center speaker in a fixed position, which is usually above or below the screen. As a result, the center channel does not follow the action within the display area, which, for a large display, may be noticeable. Further, when the audio channels of an AV presentation are presented on a setup other than the intended surround sound setup, some spatialization may be lost. For example, playing audio mixed for a 5.1 surround sound on ear-worn audio devices (e.g., ear buds, headphones, etc.), the immersive nature of the presentation may be reduced. To address these technical problems, the present disclosure describes systems and techniques to remix audio (e.g., 5.1 soundtrack) recorded for a particular surround-sound setup (i.e., 5.1 surround-sound) into an audio mix for ear-worn hearing devices that restores the spatial perception available in the surround-sound setup. What is more, the audio mix generated by the disclosed systems and methods may add spatial perception to what was originally available in the surround sound setup, thereby enhancing an immersive experience for the user. The added spatial perception may be based on information obtained from a visual portion of the AV recording and/or position/orientation information obtained from a user/environment.

Figure 3:
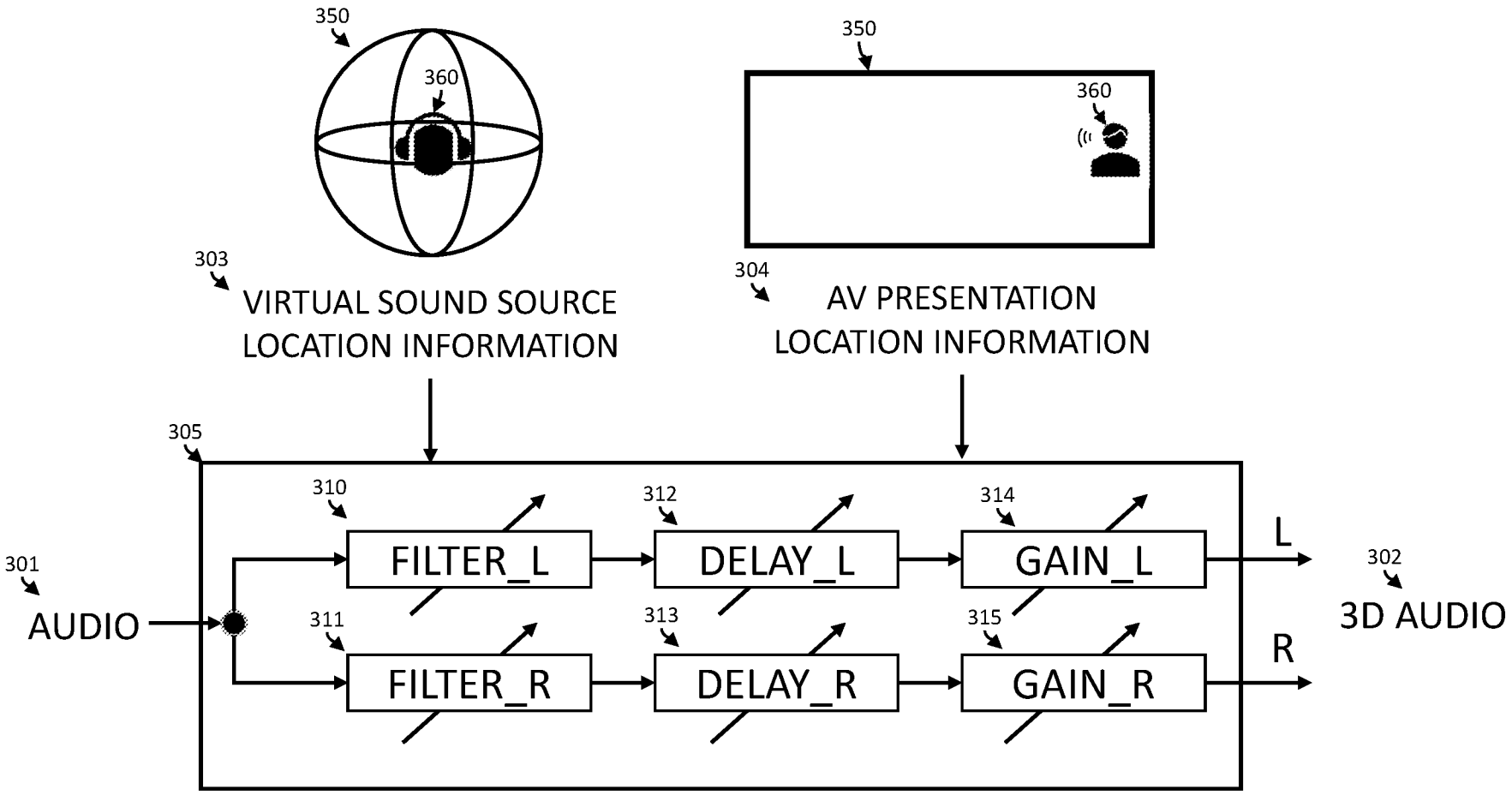
FIG. 3 is a block diagram illustrating remixing audio to generate 3D audio corresponding to a virtual environment according to an implementation of the present disclosure.

FIG. 3 is a block diagram illustrating a 3D audio mixer 305 configured to remix audio into 3D audio having including sounds that can be perceived as originating from a virtual position around the user. The remixing can include generating a left channel and a right channel from an audio channel where the left channel and the right channel are adjusted relative to each other to provide a three-dimensional (3D) spatial perception when listened to on a binaural audio device (e.g., ear-worn device). In other words, FIG. 3 is a block diagram that illustrates remixing audio to generate 3D audio corresponding to a virtual environment. The 3D audio 302 (i.e., spatial audio) generated by the 3D audio mixer 305 has a left channel (L) and a right channel (R) that can be presented to the ears of a listener (i.e., user 360) so that sounds are perceived as having emerged from sound sources located at positions in a virtual environment 350 surrounding the user 360.

The 3D audio mixer 305 is configured to receive audio 301 that can be from a channel of a multi-channel audio recording. For example, the audio 301 can be one audio channel (i.e., track) of a 5.1 surround sound soundtrack. To remix a multi-channel audio recording, each channel may be applied to the 3D audio mixer 305 in series to obtain a set of 3D audio channels (i.e., tracks). Alternatively, each channel may be applied to a corresponding 3D audio mixer in parallel to obtain the set of 3D audio channels. After remixing, the left channels of the set of 3D audio channels can be combined for playing on a left speaker and the right channels of the set of 3D audio channels can be combined for playing on a right speaker. In some implementations only a subset of the multi-channel audio tracks are remixed to create the set of 3D audio channels. In these implementations, the remixed audio tracks can be combined with the original multi-channel tracks to form the 3D audio played on the L/R speakers of a user's listening device.

The 3D audio mixer 305 may be configured with a splitter at the input to form the left channel (L) and the right channel (R). The left channel may include one or more of a left-channel adjustable filter 310 (i.e., filter L), a left-channel adjustable delay 312 (i.e., delay_L), and a left-channel adjustable amplifier/attenuator 314 (i.e., gain_L). Likewise, the right channel may include one or more of a right-channel adjustable filter 311 (i.e., filter_R), a right-channel adjustable delay 312 (i.e., delay_R), and a right-channel adjustable amplifier/attenuator 314 (i.e., gain_R).

The filter, delay, and/or gain/attenuation of the left channel may be adjusted differently from the filter, delay, and/or gain/attenuation of the right channel so that the left and right channels have a binaural difference that includes a relative filtering difference, a relative delay difference, and a relative gain/attenuation difference. The binaural difference may be generated to map the 3D audio to a desired 3D location in the virtual environment 350. Accordingly, the 3D audio mixer 305 may adjust the filter, delay, and or gain/attenuation for the left and right channels based on location information. The location information may include virtual sound source location information 305 and/or AV presentation location information 304.

The virtual sound source location information 305 may include locations that correspond to a surround sound setup specification. For example, the locations in a 5.1 surround-sound setup may be defined based on angles as described previously. Further the virtual sound source location information may include assumptions that include (but are not limited to) a relative position of a user, a relative height of a virtual speaker, a range between a user and a virtual speaker, etc. (e.g., see FIG. 1). Accordingly, a 5.1 surround-sound soundtrack can be remixed as 3D audio to be played on an ear-worn audio device so that a user may perceive being in the surround sound setup of FIG. 1. Further, if the ear-worn device includes a position/orientation sensor (i.e., inertial measurement unit, IMU) then the sounds can be adjusted to correspond with head movement so that a user senses changes to the audio when the user's head is moved. For example, when a user turns to face away from a video screen, the user may perceive a virtual center speaker located behind the user.

The techniques and methods disclosed can be used to remix multi-channel audio to create a virtual replica of a surround sound setup with fixed position speakers (i.e., virtual surround sound setup). In other words, a virtual surround-sound setup having virtual speakers in virtual locations may be generated by remixing.

Figure 4:
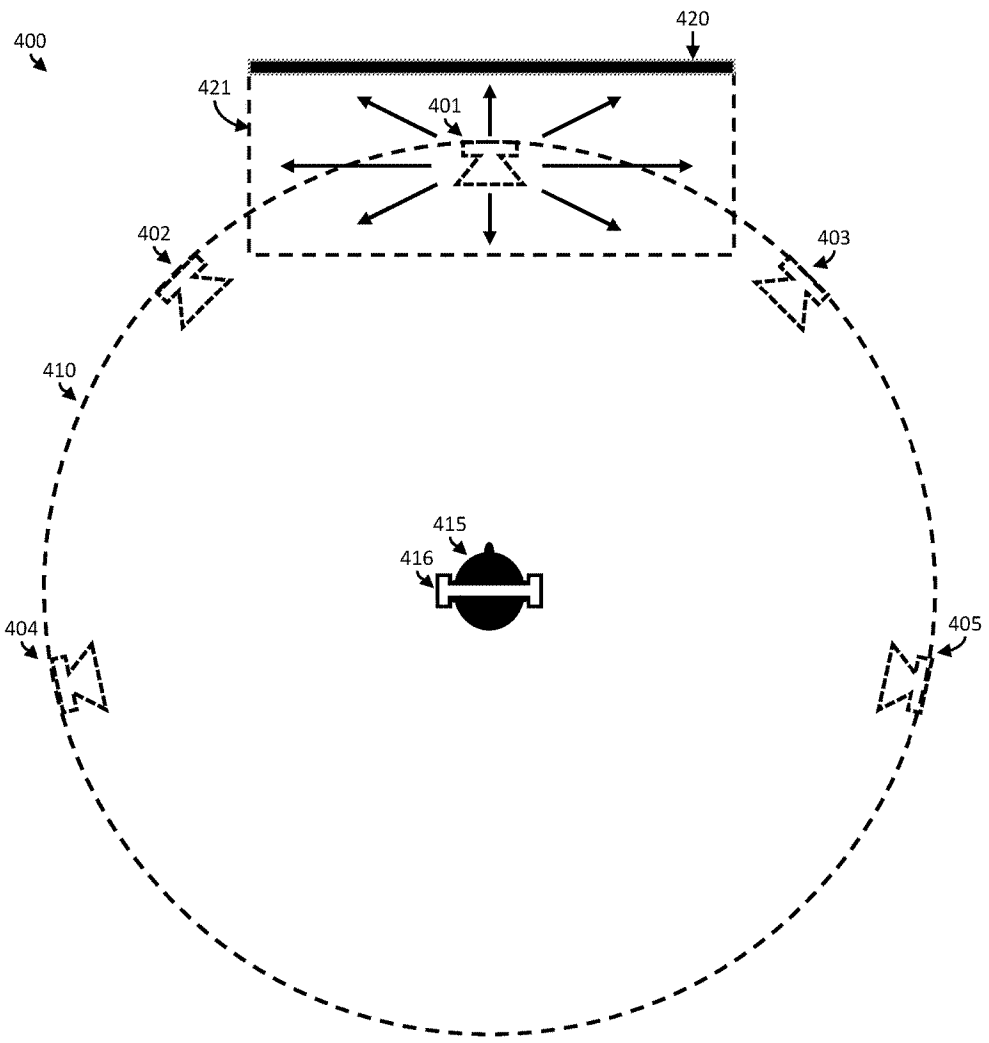
FIG. 4 is a top view of a virtual surround sound setup with an adjustable virtual center speaker according to an implementation of the present disclosure.

FIG. 4 is a top view of an example virtual surround sound setup with an adjustable virtual center speaker according to an implementation of the present disclosure. A user 415 is presented 3D audio so that the user 415 can receive 3D audio played on an ear-worn audio device 416 (e.g., headphones, earbuds, etc.) as if it emerges from the virtual surround sound setup 400. The virtual surround sound setup may be virtually located in a virtual environment 410. The virtual environment 410 may be located based on the user 415. For example, the virtual environment 410 may be centered on and surround the user 415. Alternatively, the virtual surround sound setup may be virtually located based on a display (i.e., screen 420). For example, the screen 420 may be part of a fixed device (e.g., television, projector screen, etc.) or part of a mobile device (e.g., smartphone, tablet, etc.). The screen 420 can be configured to play an AV presentation while the 3D audio may be generated based on an assumption that the user is located in front of the screen (e.g., as shown in FIG. 4).

AV presentations may include soundtracks for real (i.e., physical) surround sound setups that each include multiple audio channels configured for playback on a real surround sound setup arranged according to a surround sound setup specification (e.g., 5.1 surround sound). The present disclosure describes systems and methods to remix the soundtracks of AV presentations into 3D audio for playback over stereo devices, such as ear-worn devices to create a virtual surround sound soundtrack. When the virtual sound soundtrack is played a listener (i.e., user) can perceives the multiple audio channels being played back on a virtual surround sound setup that resembles the real surround sound setup. In other words, a soundtrack for a real surround sound setup (i.e., surround sound soundtrack for a physical surround sound setup) may be modified or replaced with a soundtrack for a virtual surround sound setup (i.e., virtual surround sound soundtrack).

Figure 5:
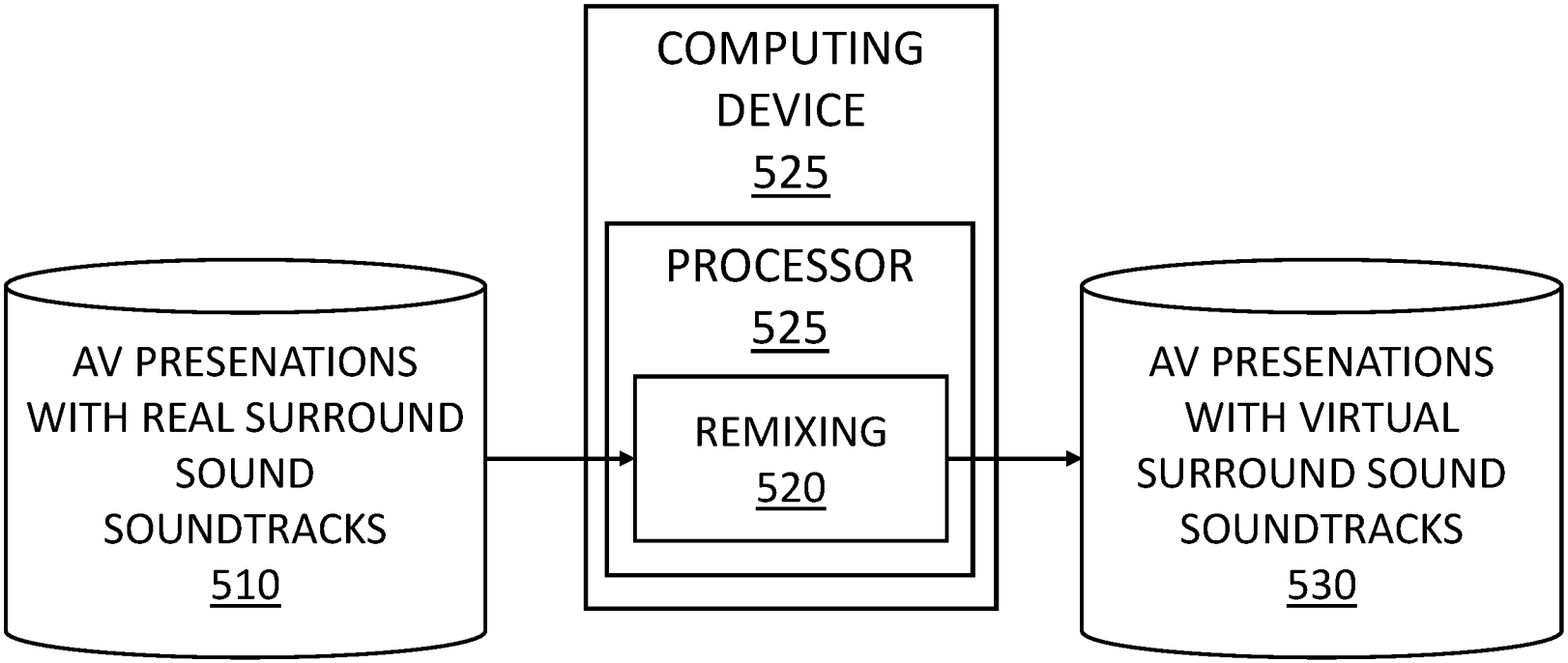
FIG. 5 is a flow chart of a remixing process according to an implementation of the present disclosure.

FIG. 5 illustrates a remixing process according to an implementation of the present disclosure. As shown, a library of real surround sound soundtracks 510 (i.e., soundtracks for physical surround sound setups) may be converted into a library of virtual surround sound soundtracks 530 by remixing 520, such as shown in FIG. 5. The remixing may be carried out by a computing device 525 configured for remixing before the AV presentations are viewed by a user. The virtual surround sound soundtracks for an AV presentation may (at least) mimic the sounds of a real (i.e., physical) surround sound setup (e.g., see FIG. 1). What is more, the disclosed systems and methods can enhance the surround sound experience through remixing in various ways, as will be described below.

The disclosed techniques and methods may enhance an immersive audio experience by making one or more of the virtual speakers movable and adjusting the virtual location of the one or more virtual speakers based on a video portion of the AV presentation. Returning to FIG. 4, the example virtual surround sound setup 400 includes five virtual speakers. The five speakers can further include a front-left virtual speaker 402, a front right virtual speaker 403, a surround left virtual speaker 404, and a surround right virtual speaker 405. These virtual speakers may include sounds associated with action in the AV presentation occurring off the screen 420. The virtual surround sound setup may further include a virtual center speaker 401. The virtual center speaker 401 may include sounds associated with action in the AV presentation occurring on the screen 420.

In virtual surround sound with single-character-tracked audio, the virtual location of the virtual center speaker 401 may be adjusted based on content of the AV presentation. For example, the virtual location of the center virtual speaker 401 may be adjusted within a virtual area 421 corresponding to the screen 420. The virtual location may be adjusted (e.g., in real time) to follow an action on the screen 420. In a possible implementation, the action is a character of the AV presentation speaking on the screen. In this case, the virtual location in the virtual area 421 may be selected so that the virtual location of the center virtual speaker 401 may be adjusted to correspond to the character's location on the screen. Further, the virtual location of the center virtual speaker 401 may be adjusted to track (i.e., follow) the user as the user changes location on the screen. This form of virtual surround sound may be called enhanced virtual surround sound, with the enhancement being single-character-tracked audio, though other sound sources besides a character can be tracked as well.

Figure 6:
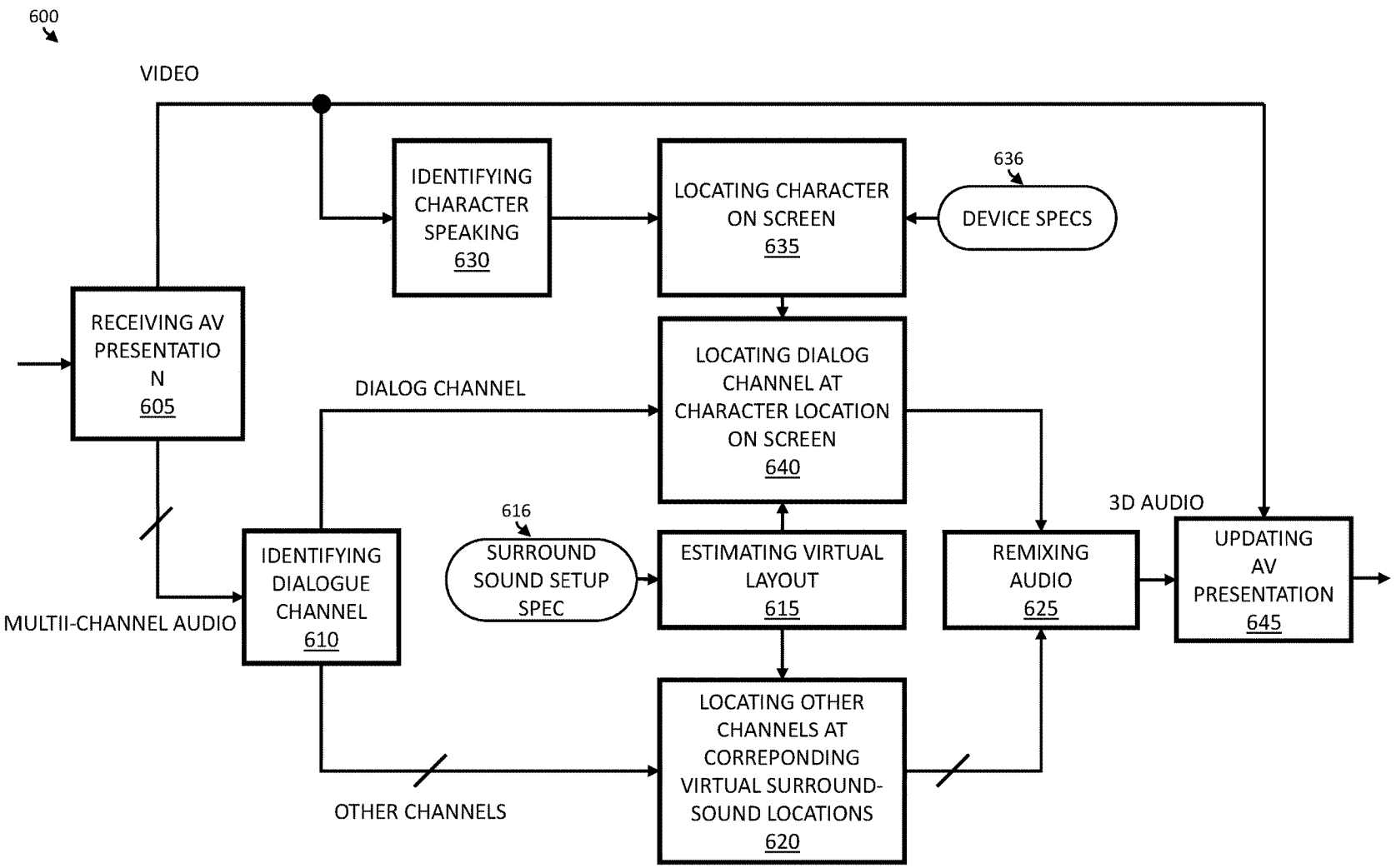
FIG. 6 is a flow chart of a method for remixing multi-channel audio from an AV presentation to generate 3D audio corresponding to a virtual surround sound setup with single-character tracked audio according to a possible implementation of the present disclosure.

FIG. 6 is a flow chart of a method for remixing multi-channel audio from an AV presentation to generate 3D audio (i.e., spatial audio) corresponding to a virtual surround sound setup with single-character-tracked audio. The method 600 includes receiving 605 an AV presentation (e.g., movie). The receiving may include parsing a video portion and a multi-channel audio portion of the AV presentation for separate processing. The method may include identifying 610 a dialog channel in the multiple channels of audio. For example, a center channel for a center speaker in a 5.1 surround sound soundtrack may be identified (i.e., selected) as the dialog channel. The identifying may include parsing (i.e., separating) the dialog channel from the other channels of the multi-channel audio for different processing. The processing may include estimating 615 a virtual layout of a surround sound system. The estimating may include receiving some surround sound setup specifications 616 corresponding to the surround sound setup. For example, nominal positions/angles of each speaker in a 5.1 surround sound setup may be provided to help estimate the virtual locations in a virtual surround-sound setup. The method includes projecting 620 the other channels (i.e., virtual speakers) to their corresponding virtual surround sound locations. The projecting 620 may include determining a relative location relative to a listener in a virtual environment. The method may then include using this virtual sound source location information to remix 625 the audio into 3D audio (i.e., spatial audio).

The method 600 may further include analyzing the video of the AV presentation to identify 630 a speaker. The identification may be performed periodically or at different intervals (e.g., scene by scene) during the AV presentation and may include using face recognition and/or speech recognition. A character of the AV presentation may be determined as speaking by analyzing video content of the AV presentation to determine gestures corresponding to speaking (e.g., lip movement). A character may be selected for tracking based on a criterion, such as how much the character speaks, which can be determined scene by scene. For example, in a scene with one character, the analysis may select the character for tracking automatically. In a scene with multiple characters the analysis may select the character speaking the most for tracking.

The identified speaking character may then be located within the screen (i.e., within a frame presented on the screen). The locating may include receiving device specifications so that the location on the screen may be correlated with a location in the virtual environment.

The dialog channel may be projected 640 to its corresponding virtual location. The virtual location of the dialog channel (i.e., virtual center speaker) may be determined based on the location of the speaking character on the screen (i.e., screen location) and the virtual location of the virtual center speaker in the virtual surround sound layer (i.e., virtual sound source location information). The dialog channel may be remixed into spatial audio conveying the perception that the virtual center speaker is located at the virtual location of the dialog channel.

In a possible implementation, the remixing 625 may include combining the remixed audio channels into a left channel and a right channel for a stereo device, such as an ear-worn device. The AV presentation may then be updated 645 to include the 3D audio soundtrack (i.e., 3D audio soundtrack). The updating may include replacing the multichannel audio soundtrack of the AV presentation with the 3D audio soundtrack or can include adding the 3D audio soundtrack to the AV presentation. The updated AV presentation may then be stored on a medium for retrieval a playback on a user's device.

In some implementations it may be desirable to track multiple characters on the screen so that the virtual center speaker may be moved from speaker to speaker in a scene. In this case the dialog channel may include a plurality of speaking characters so simply moving the virtual center speaker to a location of a speaker may be impossible or may provide an experience that is not immersive. Instead, the present disclosure describes systems and methods that can be configured to divide the dialog channel into different dialog channels and then spatially project the different dialog channels to different virtual locations in the 3D audio.

Figure 7:
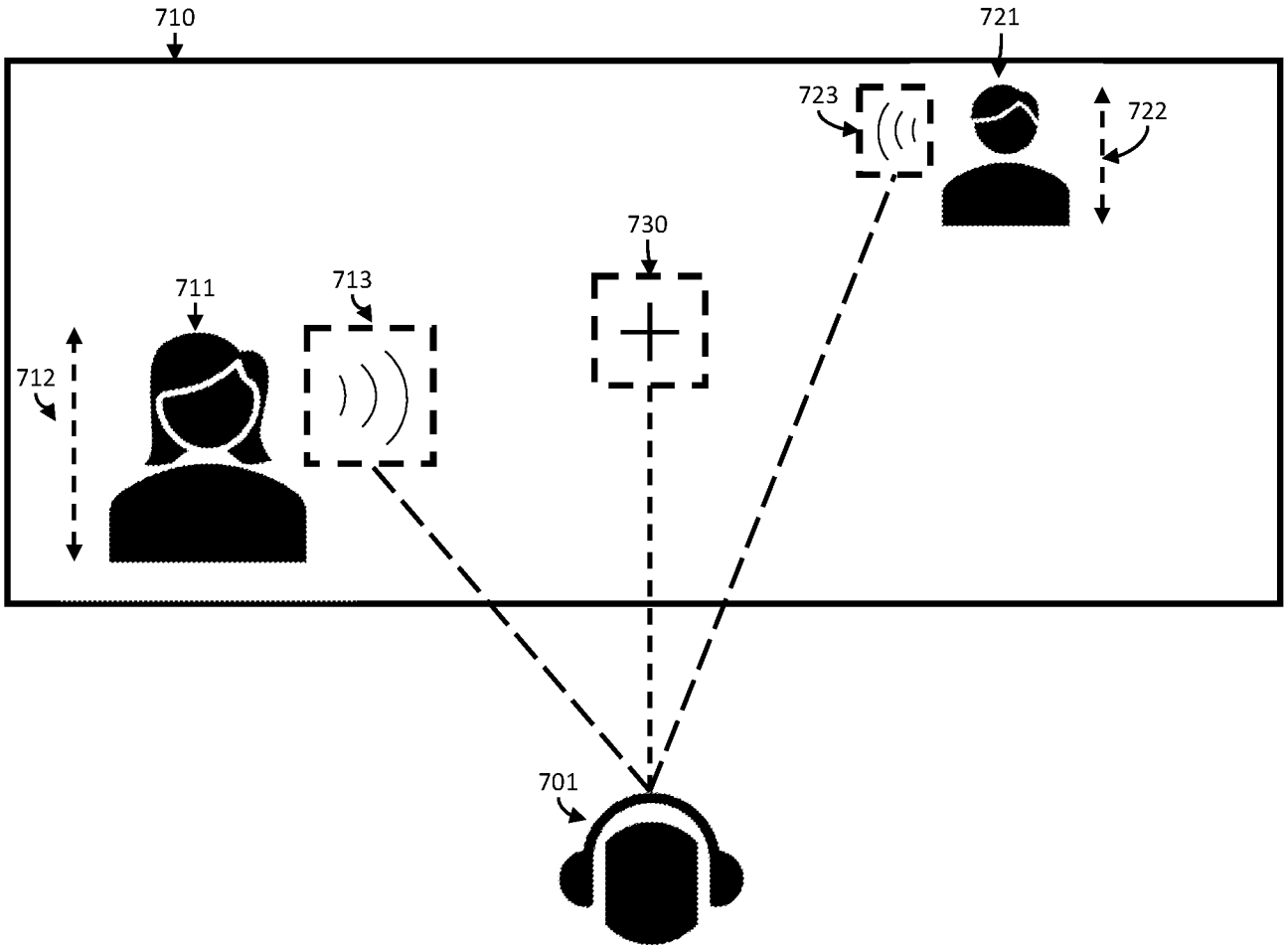
FIG. 7 illustrates a user listening to sounds that are projected to screen locations based on video content presented on the screen.

FIG. 7 illustrates a user listening to sounds that are projected to different areas based on the content of the screen. A screen presenting an AV presentation, may include a first sound source (i.e., first character 711) that is speaking at (or towards) a first location 713. The screen 710 may further include a second sound source (i.e., second character 721) that is speaking at (or towards) a second location 723. The screen may include other sounds sources (not shown). Here, rather than mapping a virtual center speaker to a source, the dialog channel (i.e., center channel) can be separated into new dialog channels for each sound source and then remixed to spatially project the sounds from each sound source to a corresponding virtual dialog speaker that is virtually located at a location on the screen. For example, a first audio track from the first character 711 may be remixed so that it can be perceived as originating from the first location 713. Likewise, a second audio track from the second character 721 may be remixed so that it can be perceived as originating from the second location 723. Likewise, a third audio track from the other sounds on the screen 710 may be remixed so that it can be perceived as originating from a third location 730 (e.g., from the center of the screen).

In some implementations, the remixing may include adjusting a volume for each audio track based on an estimated virtual range of the audio source to a user. For example, the first character 711 may be perceived as closer to the user 701 than the second character 721 (e.g., because a first size 712 of the first character is larger than a second size 722 of a second character). Accordingly, in some implementations, the first audio track may include a higher volume than the second audio track. This form of virtual surround sound may be called enhanced virtual surround sound, with the enhancement being multi-character-tracked audio, though other sound sources besides characters can be tracked as well. In some implementations, portions of a soundtrack of an AV presentation may be remixed to include enhanced virtual surround sound with single-character-tracked audio, while other portions of the soundtrack of the AV presentation may be remixed to include enhanced virtual surround sound with multi-character-tracked audio.

Figure 8:
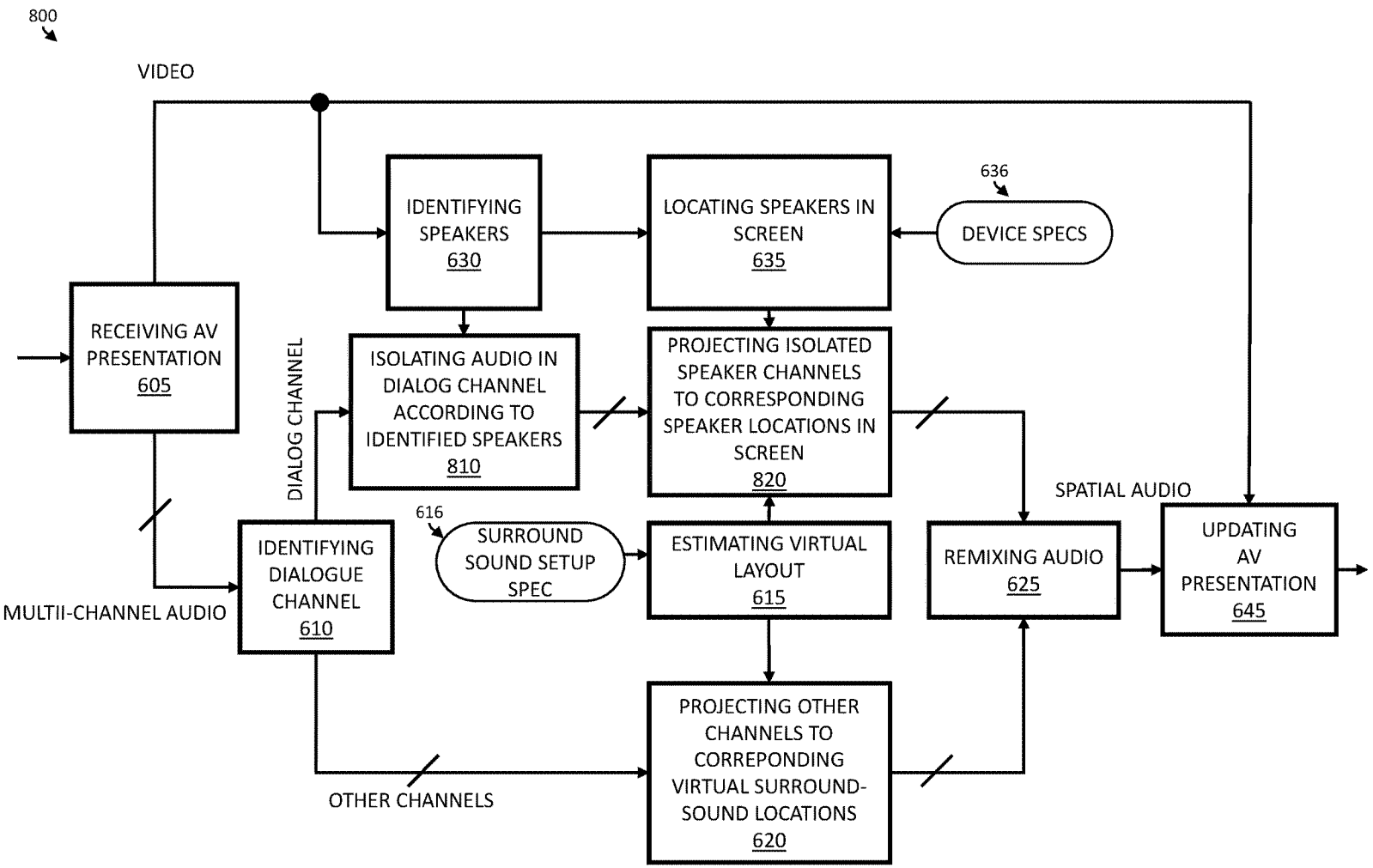
FIG. 8 is a flow chart of a method for remixing multi-channel audio from an AV presentation to generate 3D audio corresponding to a virtual surround sound setup with multiple-character-tracked audio according to a possible implementation of the present disclosure.

FIG. 8 is a flow chart of a method for remixing multichannel audio from an AV presentation to generate 3D audio (i.e., spatial audio) corresponding to a virtual surround sound setup with multiple-character-tracked audio according to a possible implementation of the present disclosure. The method 800 includes many of the operations of the remixing method 600 for single-character tracked audio described previously. The method 800 further includes isolating 810 audio in the dialog channel according to identified speakers. The speakers may be identified 630 by analyzing the video (e.g., using facial gesture recognition) and, in some implementations, correlating the video analysis with a speech analysis. In other words, a dialog channel including multiple identified speakers may be processed (e.g., using voice recognition, facial recognition, and or gesture recognition) to generate separate dialog channels for each identified speaker and/or sound source. Meanwhile, each identified speaker and/or sound source may be located 635 in the frame (i.e., screen). The method 800 further includes projecting 820 the isolated speaker channels to each corresponding virtual speaker location on the screen (i.e., in the frame).

The enhanced virtual surround sound with single character tracked audio or the enhanced virtual surround sound with multiple character tracked audio may be generated before a user views the AV presentation based on the assumption that the user is within (e.g., centered within) the virtual surround sound setup. In these implementations, no information regarding the user's position is required, and the perceived virtual speaker positions may move with the user's head. For example, the center virtual speaker may remain virtually in front of the user even as the user's head is turned to the side.

A more immersive virtual experience may be created based on information regarding a user by adjusting the remixed 3D audio in real time to match a user's changing position/orientation relative to a virtual surround sound setup during playback. For example, the center virtual speaker may be perceived as moving to one side as the user's head is turned to the side. In these implementations, the enhanced virtual surround sound with single character tracked audio or the enhanced virtual surround sound with multiple character tracked audio may be adjusted in real time based on sensing a user, a user's device, and/or an environment. This form of virtual surround sound may be called enhanced virtual surround sound, with the enhancement being user-tracked adjustments applied to the single-character-tracked audio or the multi-character-tracked audio.

Figure 9:
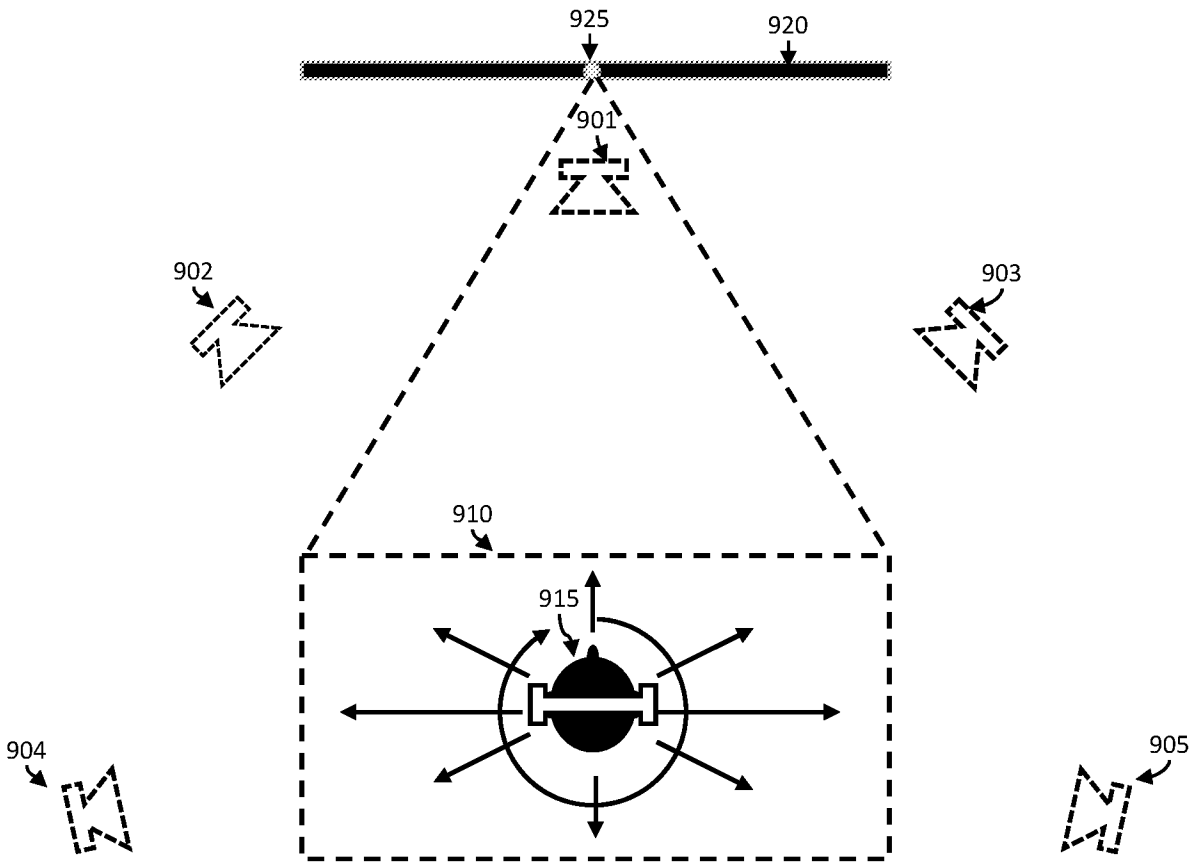
FIG. 9 illustrates user tracking in a virtual surround sound setup according to a first possible implementation of the present disclosure.

FIG. 9 illustrates user tracking in a virtual surround sound setup according to a first possible implementation of the present disclosure. In the implementation, a sensor 925, such as a camera (e.g., visible, IR, etc.) or depth sensor (e.g., structured light, millimeter wave, etc.), may be configured to measure and/or record movement of a user 915 within a field of view 910. The sensor 925 may be integrated with the screen 920 (i.e., display) so that a user watching the screen may be sensed. A change to the user's position and/or orientation may be used to adjust (i.e., update) the virtual locations of the virtual speakers 901, 902, 903, 904, 905.

Figure 10:
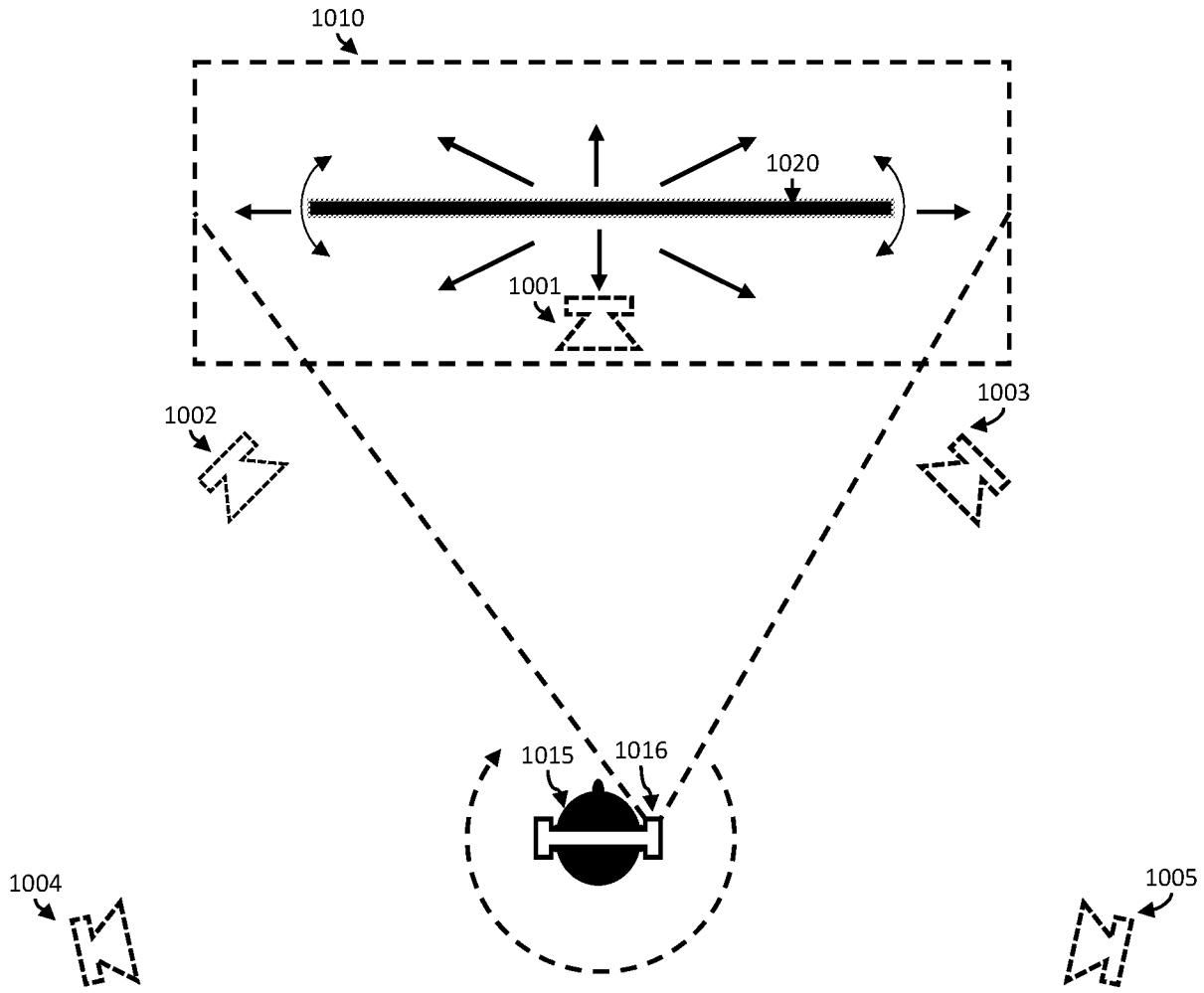
FIG. 10 illustrates user tracking in a virtual surround sound setup according to a second possible implementation of the present disclosure

FIG. 10 illustrates user tracking in a virtual surround sound setup according to a second possible implementation of the present disclosure. In the implementation, a sensor 925, such as a camera (e.g., visible, IR, etc.) or an inertial measurement unit (e.g., accelerometers, magnetometer, etc.), may be configured in a device worn or used by a user 1015. For example, the user 1015 may wear a head-worn device 1016 (e.g., smart glasses) configured to measure a relative position between the user and the screen based on images captured by the head worn device. In particular the head-worn device 1016 may include camera aligned so that the field of view 1010 overlaps with the user's field of view with image processing to recognize the screen and/or the AR presentation on the screen. Alternatively (or in addition), the head-worn device 1016 may include an inertia measurement unit (i.e., IMU) that includes one or more sensors (e.g., accelerometer, gravitometer, etc.) configured to measurement movement of the user (e.g., head movement). As a result, the head-worn device 1016 can be configured to sense and determine the user's position and/or orientation (i.e., head position) within the virtual surround sound setup. The audio mix may then be updated to change the virtual locations of the virtual speakers 1001, 1002, 1003, 1004, 1005 according to relative position and/or orientation of the user and screen (i.e., center channel).

Figure 11:
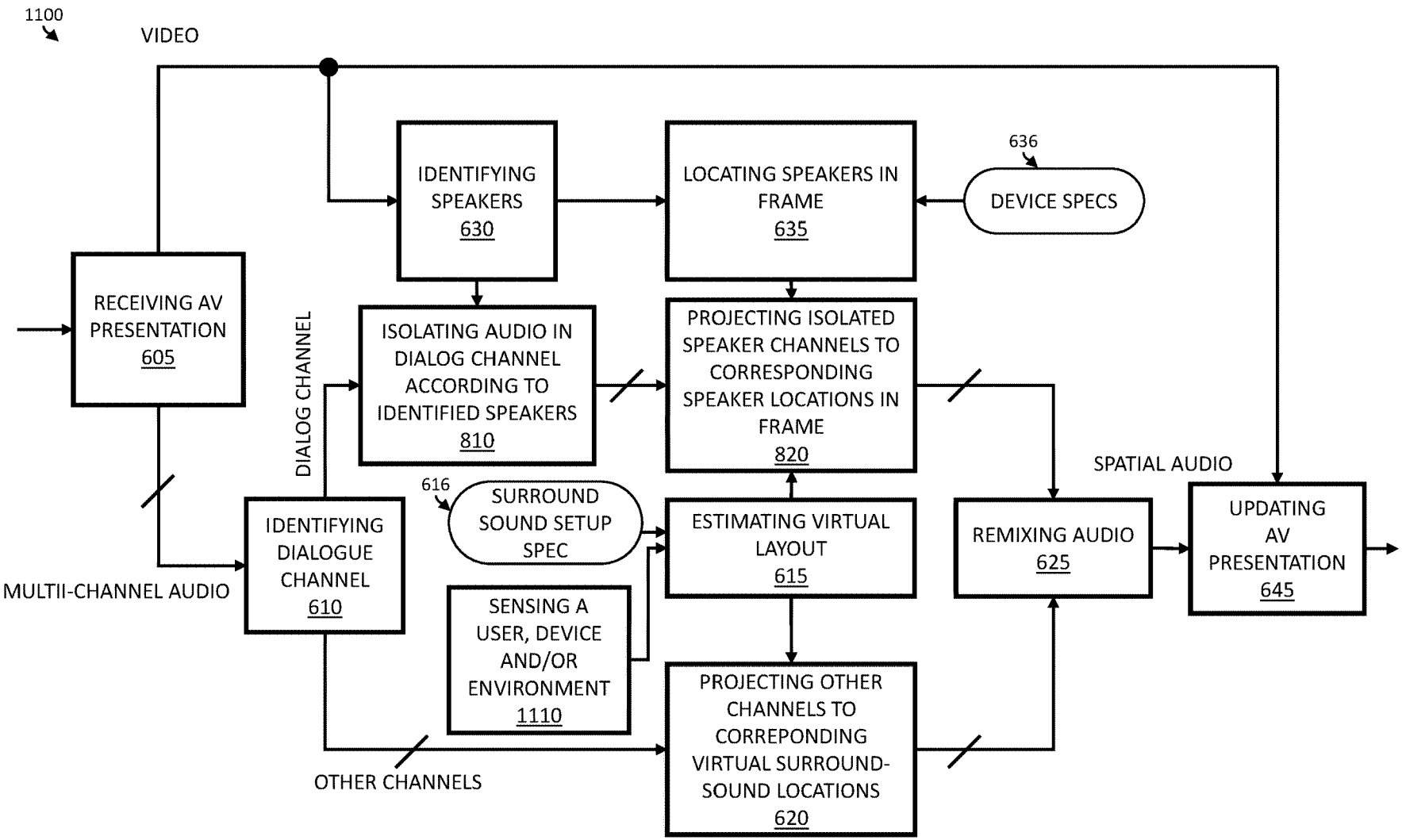
FIG. 11 is a flow chart of a method for remixing multi-channel audio from an AV presentation to generate 3D audio (i.e., spatial audio) corresponding to a virtual surround sound setup with multiple-character-tracked audio that can be adjusted based on according to user-tracked movements.

FIG. 11 is a flow chart of a method for remixing multi-channel audio from an AV presentation to generate 3D audio (i.e., spatial audio) corresponding to a virtual surround sound setup with multiple-character-tracked audio that can be adjusted according to user-tracked adjustments. The method 1100 includes many of the operations of the remixing method 800 for multi-character tracked audio described previously. The method 1100 further includes sensing a user, device, and/or environment to adjust the estimate of the virtual layout according to a relative position/orientation of the user within the virtual surround sound setup. For example, the sensing may be implemented using a sensor, or sensors, on a device (e.g., augmented-reality device) worn by a user.

In the specification and/or figures, typical embodiments have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. Ranges may be expressed herein as from "about" one particular value, and/or to "about" another particular value. When such a range is expressed, an aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

It will be understood that, in the foregoing description, when an element is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element, there are no intervening elements present. Although the terms directly on, directly connected to, or directly coupled to may not be used throughout the detailed description, elements that are shown as being directly on, directly connected or directly coupled can be referred to as such. The claims of the application, if any, may be amended to recite exemplary relationships described in the specification or shown in the figures.

As used in this specification, a singular form may, unless definitely indicating a particular case in terms of the context, include a plural form. Spatially relative terms (e.g., over, above, upper, under, beneath, below, lower, and so forth) are intended to encompass different orientations of the device in use or operation in addition to the orientation depicted in the figures. In some implementations, the relative terms above and below can, respectively, include vertically above and vertically below. In some implementations, the term adjacent can include laterally adjacent to or horizontally adjacent to.

What is claimed is:

1. A method for remixing an audiovisual (AV) presentation, the method comprising:

receiving the AV presentation that includes a video portion and a real surround sound soundtrack, the real surround sound soundtrack including multiple audio channels configured for playback on real speakers in a real surround sound setup arranged according to a surround sound setup specification;

defining virtual locations of virtual speakers in a virtual surround sound setup based on the surround sound setup specification;

modifying a virtual location of one of the virtual speakers according to a location of a first speaking character in the video portion of the AV presentation; and remixing the multiple audio channels based on the virtual locations of the virtual speakers and based on the modified virtual location of the one of the virtual speakers to generate 3D audio corresponding to the virtual speakers.

2. The method according to claim 1, further comprising:

updating the AV presentation to include a virtual surround sound soundtrack including the 3D audio.

3. The method according to claim 2, further comprising:

playing the AV presentation including the virtual surround sound soundtrack to a user;

sensing a position/orientation of the user; and adjusting the virtual locations of the virtual speakers in relation to the user according to the sensed position/orientation.

4. The method according to claim 3, wherein sensing a position/orientation of the user includes:

capturing images of the user using a camera collocated with a device configured to playback the video portion of the AV presentation; and analyzing the images to determine a relative position/orientation of the user with respect to the virtual locations of the virtual speakers.

5. The method according to claim 3, wherein sensing a position/orientation of the user includes:

capturing position information of the user using an inertial measurement unit (IMU) of a head worn device configured to play back the 3D audio; and analyzing the position information to determine a relative position/orientation of the user with respect to the virtual locations of the virtual speakers.

6. The method according to claim 1, wherein the remixing the multiple audio channels includes:

for each of the multiple audio channels:

splitting the audio channel into a left channel and a right channel;

receiving a corresponding virtual location for the audio channel; and adjusting one or more of an adjustable filter, an adjustable delay, and an adjustable amplifier/attenuator in the left channel and the right channel according to the corresponding virtual location to create one or more of a relative filtering difference, a relative delay difference, and a relative gain/attenuation difference between the left channel and the right channel so that the 3D audio sounds to a user as being from the corresponding virtual location.

7. The method according to claim 6, wherein the remixing the multiple audio channels further includes:

after 3D audio is created for each of the multiple audio channels:

combining the respective left channels and the respective right channels to create 3D audio that sounds to a user as being from virtual surround sound setup having single character tracked audio.

8. The method according to claim 1, wherein:

the location of the first speaking character in the video portion of the AV presentation is a location of the first speaking character on a screen during playback of the video portion.

9. The method according to claim 8, wherein:

the video portion of the AV presentation is a movie:

the real surround sound soundtrack is a 5.1 surround sound soundtrack for the movie, the 5.1 surround sound soundtrack including a dialog channel; and the 3D audio includes the dialog channel configured for playback on a virtual center speaker located at the location of the first speaking character on the screen during playback of the movie.

10. The method according to claim 9, wherein:

the 3D audio further includes a virtual front left speaker, a virtual front right speaker, a virtual surround left speaker and a virtual surround right speaker, each virtual speaker configured to play corresponding audio channels from the 5.1 surround sound soundtrack at virtual locations corresponding to the surround sound setup specification.

11. The method according to claim 1, the modifying a virtual location of one of the virtual speakers to a location of a first speaking character in the video portion of the AV presentation includes:

selecting a dialog channel from the multiple audio channels;

analyzing the dialog channel to identify speech;

analyzing the video portion of the AV presentation to recognize gestures corresponding to the speech;

locating the first speaking character in the video portion of the AV presentation based on the gestures corresponding to the speech; and modifying the virtual location of a virtual center speaker to playback the dialog channel at the location of the first speaking character.

12. The method according to claim 11, further comprising:

after modifying the virtual location of the virtual center speaker to playback the dialog channel at the location of the first speaking character:

locating a second speaking character in the video portion of the AV presentation based on the gestures corresponding to the speech; and modifying the virtual location of the virtual center speaker to playback the dialog channel at the location of the second speaking character.

13. A method for remixing an audiovisual (AV) presentation, the method comprising:

receiving the AV presentation that includes a video portion and a real surround sound soundtrack, the real surround sound soundtrack including multiple audio channels configured for playback on real speakers in a real surround sound setup arranged according to a surround sound setup specification;

selecting a dialog channel from the multiple audio channels;

analyzing the dialog channel to identify speech from multiple speaking characters;

creating a plurality of new dialog channels for each of the multiple speaking characters, each new dialog channel including the speech from one of the multiple speaking characters;

determining locations of each of the multiple speaking characters in the video portion of the AV presentation;

defining virtual locations of virtual dialog speakers for playback of the plurality of new dialog channels, the virtual locations of the virtual dialog speakers each corresponding to a location of one of the multiple speaking characters in the video portion of the AV presentation;

determining virtual locations of other virtual speakers for playback of the multiple audio channels not selected as the dialog channel, each virtual location of each other virtual speaker corresponding to a surround sound setup specification; and remixing the multiple audio channels including the plurality of new dialog channels based on the virtual locations to generate 3D audio corresponding to the virtual dialog speakers and the other virtual speakers.

14. The method according to claim 13, further comprising:

updating the AV presentation to include a virtual surround sound soundtrack including the 3D audio.

15. The method according to claim 14, further comprising:

playing the AV presentation including the virtual surround sound soundtrack to a user;

sensing a position/orientation of the user; and adjusting the virtual locations of the virtual dialog speakers and the other virtual speakers in relation to the user according to sensed position/orientation.

16. The method according to claim 15, wherein sensing a position/orientation of the user includes:

capturing images of the user using a camera collocated with a device configured to playback the video portion of the AV presentation; and analyzing the images to determine a relative position/orientation of the user with respect to the virtual locations of the virtual dialog speakers and the other virtual speakers.

17. The method according to claim 15, wherein sensing a position/orientation of the user includes:

capturing position information of the user using an inertial measurement unit (IMU) of a head worn device configured to play back the 3D audio; and analyzing the position information to determine a relative position/orientation of the user with respect to the virtual locations of the virtual dialog speakers and the other virtual speakers.

18. The method according to claim 13, wherein the remixing the multiple audio channels including the plurality of new dialog channels based on the virtual locations to generate 3D audio includes:

for each of the multiple audio channels and the plurality of new dialog channels:

splitting the audio channel into a left channel and a right channel;

receiving a corresponding virtual location for the audio channel; and adjusting one or more of an adjustable filter, an adjustable delay, and an adjustable amplifier/attenuator in the left channel and the right channel according to the corresponding virtual location to create one or more of a relative filtering difference, a relative delay difference, and a relative gain/attenuation difference between the left channel and the right channel so that the 3D audio sounds to a user as being from the corresponding virtual location.

19. The method according to claim 18, wherein the remixing the multiple audio channels further includes:

after 3D audio is created for each of the multiple audio channels and the plurality of new dialog channels:

combining the respective left channels and the respective right channels to create 3D audio that sounds to a user as being from a virtual surround sound setup having multiple character tracked audio.

20. The method according to claim 13, wherein:

the locations of the multiple speaking characters in the video portion of the AV presentation each correspond to a location of one of the multiple speaking characters on a screen during playback of the video portion.

21. The method according to claim 13, further including:

defining a virtual location of a virtual center speaker for playback of sounds not identified as speech from the multiple speaking characters, the virtual location of the virtual center speaker corresponding to a location of a center speaker in the surround sound setup specification.

* * * * *